United States Patent [19]

Joseph et al.

[11] 4,435,678

[45] Mar. 6, 1984

[54] LOW VOLTAGE PRECISION CURRENT SOURCE

[75] Inventors: Eric D. Joseph, Mesa; Robert B. Davies, Tempe, both of Ariz.

[73] Assignee: Motorola, Inc., Schaumburg, Ill.

[21] Appl. No.: 352,901

[22] Filed: Feb. 26, 1982

[51] Int. Cl.[3] ..... G05F 1/56

[52] U.S. Cl. ..... 323/273; 323/281; 323/315

[58] Field of Search ..... 323/311-316, 323/273, 281; 330/288

[56] References Cited

U.S. PATENT DOCUMENTS

| | | | |
|---|---|---|---|
| 3,813,607 | 5/1974 | Voorman | 323/315 |
| 4,329,639 | 5/1982 | Davis | 323/315 |
| 4,341,990 | 7/1982 | Davis | 323/273 |
| 4,396,883 | 8/1983 | Holloway et al. | 323/313 |

FOREIGN PATENT DOCUMENTS

| | | | |
|---|---|---|---|
| 2078036 | 12/1981 | United Kingdom | 330/288 |

OTHER PUBLICATIONS

IBM Technical Disclosure Bulletin, vol. 13, No. 6, p. 1699, Nov. 1970.

*Primary Examiner*—William H. Beha, Jr.
*Attorney, Agent, or Firm*—Michael D. Bingham

[57] ABSTRACT

A circuit for providing a current at an output thereof of a predetermined value which has excellent ripple rejection characteristics whereby the magnitude of the current is maintain substantially constant with variations in the voltage supply applied thereto. The current source includes first and second complementary current mirror circuits interconnected such that the second current mirror sinks the current sourced from the first current mirror. A feedback loop latches the circuit into a stable operation and senses any difference current between the two current mirror circuits caused by perturbations of the supply voltage to produce feedback to maintain the circuit at its quiescent operating point.

4 Claims, 2 Drawing Figures

LOW VOLTAGE PRECISION CURRENT SOURCE

CROSS REFERENCE TO A RELATED PATENT AND APPLICATION

The subject matter of the present invention is related to the subject matter of the related application Ser. No. 352,902, entitled "Voltage Regulator Circuit."

BACKGROUND OF THE INVENTION

This invention relates to a solid state current source circuit and, more particularly, to a precision current source having ripple rejection characteristics whereby the magnitude of current provided therefrom remains substantially constant with variations in the magnitude of the power supply voltage applied thereto. The current source may be utilized to provide a regulated DC output voltage across a load that is coupled to ground reference potential.

The prior art is replete with various types of current sources and voltage regulator circuits for supplying constant output currents and DC regulated voltages. Most of these types of circuits work quite well in environments wherein little or no variation in the magnitude of the supply voltage is permitted. However, many such systems are adversely affected by excessive noise transient spikes that may create large variations in the supply voltage line.

For example, in magnetic bubble memory sensing systems the power supply present is required to provide currents of one ampere peak to the x and y field coils of the bubble memory. These currents are switched at the field rotation frequency, between 50 and 200 KHz, with rise and fall times within 200 nanoseconds. This switching can cause voltage transient spikes to appear on the supply line that can otherwise prevent detection of the magnetic bubble since the magnitude of these spikes are large with respect to the magnitude of a bubble present signal.

Thus, there is a need for a current source circuit that can be utilized to provide a DC regulated voltage which exhibits excellent ripple rejection characteristics. Such a circuit could be employed in a bubble memory sense system, for instance, to reject high frequency components of the switching transients.

SUMMARY OF THE INVENTION

Accordingly, it is an object of the present invention to provide an improved current source.

It is another object of the present invention to provide an improved low voltage precision current source.

An additional object of the present invention is to provide a current source suitable for fabrication in monolithic integrated circuit form having excellent ripple rejection characteristics.

Still another object of the present invention is to provide an integrated current source circuit having excellent ripple rejection which can be utilized in a voltage regulator for producing a DC regulated voltage across a load coupled thereto, the load being coupled to ground reference potential.

In accordance with the above and other objects there is provided a precision current source comprising first and second interconnected complementary current mirror circuits. A feedback loop is coupled with the two current mirror circuits which senses a difference current therebetween which occurs due to variations of the supply voltage applied across the first and second current mirror circuits to provide a feedback signal to the first current mirror circuit to inhibit this difference current.

DETAILED DESCRIPTION OF THE INVENTION

Figure 1:
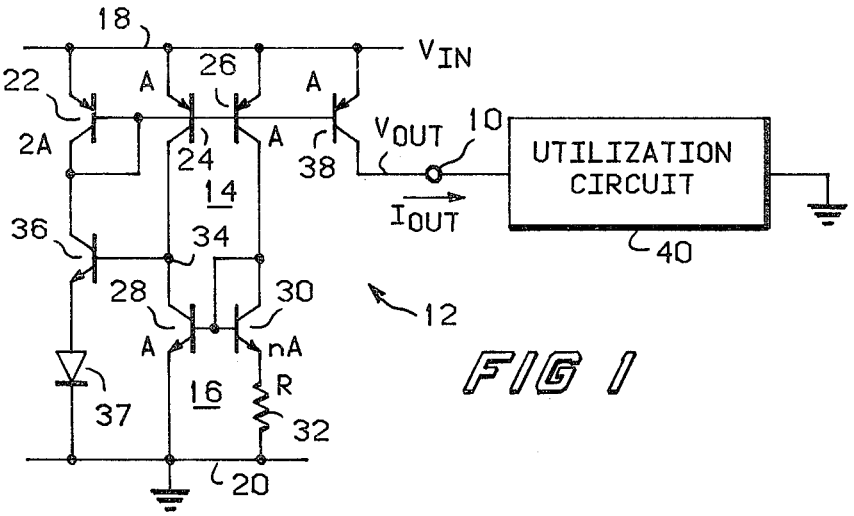
FIG. 1 is a schematic diagram illustrating the current source of the invention.

Turning to FIG. 1, there is shown a simplified schematic of a low voltage precision current source, suitable for fabrication as an integrated circuit, which is utilized to provide a precision regulated DC voltage at output terminal 10 in accordance with the preferred embodiment of the present invention. Current source 12 comprises interconnected complimentary current mirror circuits 14 and 16 as well as feedback means coupled there between for setting the quiescent operating point of the circuit while providing ripple rejection to variations in the power supply voltage $V_{in}$ supplied across conductors 18 and 20.

Current mirror circuit 14 includes PNP transistors 22, 24 and 26 with respective emitters coupled to conductor 18 and respective bases commonly connected to each other. Transistor 22 is connected as a diode and functions in a known manner to force the currents sourced at the collectors of transistors 24 and 26 to be substantially of equal magnitude. Although, the emitter areas of transistors 22, 24 and 26 may be equal, the emitter area of transistor 22 is shown as being ratioed with respect to the emitter areas of transistors 24 and 26. In the present case, the emitter area of transistor 22 is illustrated as being equal to twice the area of the emitters of transistors 24 and 26. Hence, transistor 22 will source twice the collector current of either transistor 24 or 26.

Current mirror circuit 16 includes NPN transistors 28 and 30. Transistor 30 is connected as a diode and is shown as having an emitter of area n times the emitter area of transistor 28. The base electrodes of these two transistors are connected to one another with the emitter of transistor 28 being returned to ground reference via conductor 20. The emitter of transistor 30 is returned to conductor 20 through resistor 32 which as shown has a resistance value equal to R.

A feedback loop is provided by feedback NPN transistor 36 which has its collector-emitter path coupled between the collector of transistor 22 and power supply conductor 20 via biasing diode 37. The base of transistor 36 is coupled to both current mirrors 14 and 16 at node 34.

In operation, current sourced at the collector of transistor 26 flows through the collector-emitter path of transistor 30. This produces current flow in the collector-emitter path of transistor 28 to sink the current sourced at the collector of transistor 24. Because transistor 28 and 30 are operated at different current densities, a voltage is produced across resistor 32 which is substantially equal to the difference in the base-to-emitter voltage developed across these two transistors and is referred to as $\Delta V_{be}$. Thus, the collector-emitter current of transistor 30 has a value which can be shown to be substantially equal to:

$$\frac{kT}{qR} \ln n \quad (1)$$

where:

k is Boltzmann's constant

T is the absolute temperature q is the charge of an electron

Since transistors 24 and 26 are matched (having equal emitter areas and characteristics) the magnitude of the collector currents source therefrom will be substantially equal. However, since transistor 28 sinks only $1/n^{th}$ of the available current sourced from transistor 24, an excess current is available at node 34 which renders feedback transistor 36 conductive. Thus, as transistor 36 is rendered conductive, current is sourced from the collector of transistor 22 via its collector-emitter path. This action increases the current that is sourced from the collectors of transistors 24 and 26 as these two transistors are caused to be rendered more conductive. This regeneration action continues until such time that a quiescent operating point is reached. The quiescent operating point is nominally the state at which the magnitude of the collector currents of transistors 28 and 30 are substantially equal and the $\Delta V_{be}$ between transistors 28 and 30 is substantially equal to the voltage drop caused by said current in resistor 32.

PNP output transistor 38 has its emitter and base coupled in parallel with the emitter and base of respective current sourcing transistors 24 and 26. The collector of transistor 38 is coupled at output terminal 10 to a utilization circuit 40 which is returned to ground potential. The emitter area of transistor 38 may be made any ratio of the emitter areas of respective transistors 24 and 26. However, as illustrated, transistor 38 is matched with transistors 24 and 26. Hence, the collector current sourced from transistor 38 will be substantially equal in magnitude to the collector currents of transistors 24 and 26. Therefore, the output current, $I_{out}$, is substantially equal to the collector current of transistor 26 which itself is a function of the current $\Delta V_{be}/R$. At the quiescent operating point $I_{out}$ is substantially equal to:

$$\frac{kT}{qR} \ln n \quad (2)$$

and a regulated DC output voltage $V_{out}$ is provided at output terminal 10, across utilization circuit 40.

The above described circuit provides ripple rejection to perturbations in the magnitude of $V_{in}$ as will hereinafter be described. If, for example, the magnitude of the voltage $V_{in}$ should vary in a direction to cause the upper current source transistors 22, 24 and 26 to attempt to become more conductive, transistor 30 will initially become more conductive to sink the increased collector current from transistor 26. This action increases the voltage drop across resistor 32 which in turn raises the voltage level appearing at the base of transistor 28. Transistor 28 will thus become more conductive to sink more than the additional current sourced from transistor 24. As transistor 28 is rendered more conductive, the voltage level appearing at the base of transistor 36 decreases in magnitude. This causes transistor 36 to become less conductive to, in-turn, reduce the collector currents sourced by transistors 22, 24, and 26. Under general operating conditions, the feedback loop response time is fast enough to respond to variations in $V_{in}$ to maintain the output current sourced to output node 10 constant as the voltage $V_{in}$ varies within a predetermined range. Likewise, if $V_{in}$ varies in an opposite direction, transistor 36 is rendered more conductive, to cause the PNP current source transistors to conduct harder thereby maintaining $I_{out}$ substantially constant.

A problem may arise if current source 10 is operated in a noisy environment where noise transient spikes may occur having relatively high frequencies. At higher frequencies errors may occur at the output of the circuit which reduces the circuit's ripple rejection characteristics. The main source of these errors is due to the phase shift associated through the feedback loop comprising transistor 36. This phase shift prevents instantaneous tracking of variations in the magnitude of the supply voltage $V_{in}$.

Figure 2:
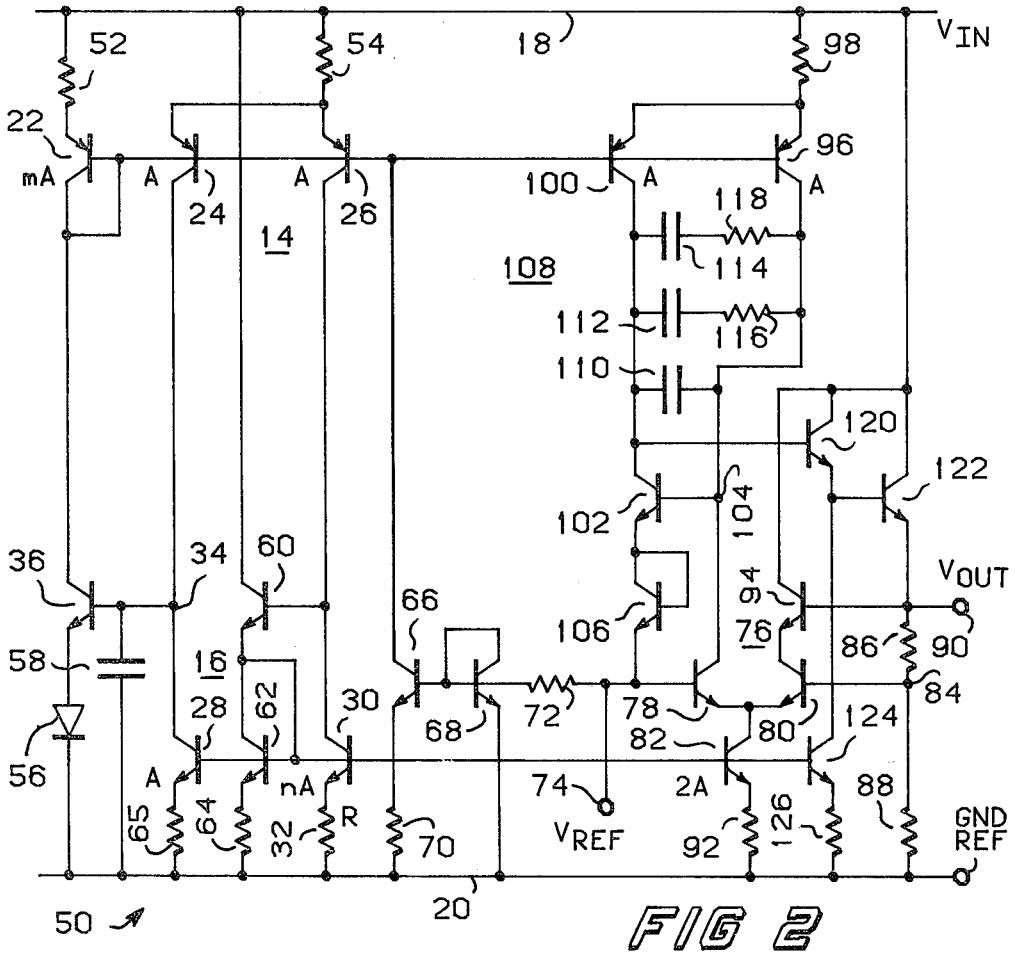
FIG. 2 is a schematic diagram illustrating a voltage regulator circuit incorporating the current source of the present invention.

Turning now to FIG. 2 there is shown voltage regulator circuit 50 which incorporates the features of current source 12 described above to produce a DC regulated output voltage $V_{out}$ at an output thereof. It is to be understood that components of voltage regulator circuit 50 corresponding to like components of current source 12 are referenced by the same reference numerals.

Regulator circuit 50 provides voltage supply ripple rejection to voltage transients appearing on the voltage supply line 18 which can have very high frequency components. In fact, regulator circuit 50 provides very good voltage supply ripple rejection to transient spikes having frequency components at ten megahertz and higher.

As illustrated, emitter degeneration resistors 52 and 54 are placed between the emitters of transistors 22, 24 and 26 and power supply conductor 18 of current mirror circuit 14 which, among other things, provide enhanced matching between these transistors. Transistor 22 is illustrated as having an emitter area m times the emitter areas of transistors 24 and 26, where m may be any desired number. Diode 56, which corresponds to diode 37, is placed between the emitter of transistor 36 and conductor 20 for biasing the emitter of this transistor at a $V_{be}$ above ground reference. Capacitor 58, which is coupled between the base of transistor 36 and conductor 20, provides compensation for the high gain feedback loop comprising transistor 36 to prevent oscillations that otherwise may occur. Current mirror circuit 16 includes NPN transistor 60 which acts as a well known "beta current" eliminator to reduce current errors in the mirror circuit due to the base currents of transistors 28, 30, 62, 82, and 124. Diode connected NPN transistor 62, having its emitter coupled via resistor 64 to conductor 20 and its collector connected to the emitter of transistor 60, forces a known current to be sourced through transistor 60. Transistors 30 and 60 form the diode element of current mirror 16 as is understood. In addition, transistor 28 includes a resistor 65 connected between the emitter of this transistor and conductor 20.

Because voltage regulator circuit 50 is suitable to be manufactured in monolithic integrated circuit form, a start-up circuit is provided which comprises transistors 66 and 68, and resistors 70 and 72. As bias reference voltage, $V_{ref}$, is supplied at terminal 74 current flows through resistor 72 and diode connected transistor 68. Transistor 66 and 68 are connected as a current mirror whereby current is therefore caused to flow through the collector-emitter path of transistor 66 and resistor 70 as $V_{in}$ is supplied to the circuit. Resistor 70 is of sufficient value to limit the collector current through transistor 66 to a small known value. However, this collector current is sufficient to render current source transistors 22, 24 and 28 conductive as the collector current of transistor 66 is sourced from these transistors. Thus, transistors 22, 24, and 28 are rendered conductive to initiate the regenerative feedback action of transistor 36, as previously described, to latch the regulator circuit into a nominal quiescent operating point wherein the collector currents of transistors 28 and 30 are made substantially equal to each other. A utilization or load circuit that is returned to ground reference potential is provided at the output of the current source which includes a comparator amplifier. The comparator amplifier has an input stage and an output stage. Differential gain stage 76 comprises the input stage of the comparator amplifier and includes NPN transistors 78 and 80 the emitters of which are connected in common to the collector of current source transistor 82. The base of transistor 78, which serves as one input of the differential amplifier, is coupled to terminal 74 and is biased at $V_{ref}$. The base of transistor 80 is coupled to node 84 between the interconnection of series connected resistors 86 and 88. These two resistors are connected between output terminal 90 and conductor 20. Current source transistor 82 supplies the tail current through amplifier 76. The emitter of transistor 82 is coupled via resistor 92 to conductor 20 with the base being connected to the bases of transistors 28 and 30 of current mirror circuit 16 such that the base-emitter path of transistor 82 is coupled in parallel with these latter devices. NPN transistor 94 is connected in cascode between the collector of transistor 80 and conductor 18 and has its base coupled to output terminal 90. As is understood, cascoded transistor 94 is provided to reduce Early voltage errors that may be caused by any difference voltage occurring between the collectors of transistors 76 and 80. Transistor 94 establishes the voltage at the collector of transistor 80 to reduce such errors. Therefore, the operation of differential amplifier 76 is then less likely to effect the magnitude of $V_{out}$ due to temperature changes of the integrated chip as well as input voltage supply variations.

The collector of transistor 78 of amplifier 76 is connected to the collector of PNP current source transistor 96 at an output of current source 14. The base-emitter path of transistor 96 is coupled in parallel to the base-emitter paths of transistors 24 and 26 via emitter degeneration resistor 98. Similarly, PNP transistor 100 has its base-emitter path coupled in parallel to transistor 96 with the collector thereof being coupled at another output of current source 14 to the collector of NPN transistor 102. Transistor 102 and diode connected NPN transistor 106 form the output stage of the comparator amplifier. The base of transistor 102 is connected to the collector of transistor 78 at node 104. Diode connected transistor 106 is coupled between the emitter of transistor 102 and terminal 74. Transistors 96, 100, 102, and 106 and resistor 98 form a gain stage across which pole splitting frequency compensation circuit 108 is provided. Compensation circuit 108 comprises capacitor 110 coupled between the collector of transistor 102 and node 104, as well as capacitors 112, and 114 that are coupled respectively in series with resistors 116 and 118 in parallel to capacitor 110.

A Darlington amplifier follower stage comprising NPN transistors 120 and 122 as well as NPN transistor 124 is connected between the collector of transistor 102 and voltage supply $V_{in}$ to output terminal 90. Transistor 124 which has its collector-emitter path coupled between emitter and base interconnections of transistors 120 and 122 and conductor 20 via resistor 126 and its base connected in common with the base of transistor 82 to current mirror circuit 16 is provided to increase the operating speed of the Darlington follower stage as is understood.

The output voltage, $V_{out}$, appearing at output terminal 90 is made proportional to the voltage $V_{ref}$ via the resistive divider comprising resistors 86 and 88. Thus, in response to an output signal from the Darlington amplifier, the voltage appearing at node 84 is forced to a voltage level that causes the collector currents of transistor 78 and 80 to be substantially equal in magnitude by the feedback action through resistors 86 and 88. Moreover, the respective collector currents of these two transistors will be ideally one-half the value of the tail current flowing through transistor 82. This value of the tail current is set by current mirror 16.

Rejection to lower frequency variations in the magnitude of $V_{in}$ is provided as aforedescribed with reference to FIG. 1. Hence, if $V_{in}$ should increase in level, the initial increase in current sourced from current mirror 14 increases the current flow in current mirror 16. This causes the tail current through transistor 82 to increase whereby any increase in current source by transistors 96 and 100 is sourced through transistors 78 and 80. Hence, the quiescent operating level at the base of transistor 120, the input of the Darlington follower stage, remains substantially the same which inhibits any changes in the level of the output DC regulated voltage $V_{out}$.

The frequency response of regulator circuit 50 is increased over the circuit described with respect to FIG. 1 by the addition of the gain stage comprising transistors 96, 100, 102, and 106, resistor 98 and compensation circuit 108.

The gain stage and the compensation circuit introduce frequency domain zeros and poles which can be tailored to offset the poles generated by the remainder of the circuit comprising the voltage regulator whereby the response characteristics of the ratio $V_{out}/V_{in}$ can be tailored to provide enhanced ripple rejection performance of the regulator to the higher frequency components of the transient input voltage spikes.

Additionally, variations in the impedance of the voltage source $V_{ref}$ due to its frequency characteristics can be tailored by feedback through transistors 102, 106 and associated circuitry to maintain the impedance presented to differential amplifier 76 substantially constant with frequency. This improves the operation of the differential amplifier to enhance its performance at higher frequencies.

A voltage regulator circuit fabricated in accordance with the above disclosure provided ripple rejection greater than −30db at frequencies up to 10 MHz while exhibiting stable operation. The unity gain cross over point occurs at approximately 75 MHz with 68° of phase margin. The circuit was fabricated using the following component values:

| Component and Transistor Ratios | Value |
|---|---|
| Capacitor 58 | 40 pF |
| Capacitor 110 | 2.5 pF |
| Capacitor 112 | 5.0 pF |
| Capacitor 114 | 20.0 pF |
| Resistor 32 | 1360 ohms |

-continued

| Component and Transistor Ratios | Value |
|---|---|
| Resistors 52,54,98,92 | 500 ohms |
| Resistor 64,65 | 1000 ohms |
| Resistor 70 | 20,000 ohms |
| Resistor 72 | 50,000 ohms |
| Resistor 86 | 6970 ohms |
| Resistor 88 | 3030 ohms |
| Resistor 116 | 1500 ohms |
| Resistor 118 | 4000 ohms |
| Resistor 126 | 1000 ohms |
| n | 4 |
| m | 2 |

We claim:

1. A precision current source, comprising:

first and second power supply conductors adapted to receive a supply voltage thereacross;

first and second complementary current mirror circuits interconnected to each other between said first and second power supply conductors, said first current mirror circuit sourcing currents to said second current mirror circuit;

feedback circuit means for sensing a difference current between said first and second complementary current mirror circuits caused by variations in said supply voltage to provide a feedback signal to inhibit said difference current, said feedback circuit means including a first transistor of a first conductive type having an emitter, a collector and a base, said emitter being coupled to said second power supply conductor, said collector being coupled to said first current mirror circuit to sink current sourced thereto, said base being coupled both to said first and second complementary current mirror circuits at a first circuit node; and output circuit means coupled with said first current mirror circuit having an output adapted to be coupled to an utilization means for sourcing a predetermined and substantially constant current thereto.

2. The current source of claim 1 wherein said first current mirror circuit includes:

a second transistor of a second conductivity type having an emitter, a collector and a base, said emitter being coupled to said first power supply conductor, said collector being coupled with said base to said collector of said first transistor;

a third transistor of said second conductivity type having an emitter, a collector and a base, said emitter being coupled to said first power supply conductor, said base being coupled to said base of said second transistor, said collector being coupled to said first circuit node; and a fourth transistor of said second conductivity type having an emitter, a collector and a base, said emitter being coupled to said first power supply conductor, said base being coupled to said base of said third transistor, said collector being coupled to said second current mirror circuit at a second circuit node.

3. The current source of claim 2 wherein said second current mirror circuit includes:

a fifth transistor of said first conductivity type having an emitter, a collector and a base, said collector being coupled with said base to said second circuit node;

resistive circuit means coupled between said emitter of said fifth transistor and said second power supply conductor; and a sixth transistor of said first conductivity type having an emitter, a collector and a base, said base being coupled to said base of said fifth transistor, said emitter being coupled to said second power supply conductor, said collector being coupled to said first circuit node.

4. The current source of claim 3 wherein said output circuit means includes a seventh transistor of said second conductivity type having an emitter, a collector and a base, said emitter being coupled to said first power supply conductor, said base being coupled to said base of said fourth transistor, said collector being coupled to said output of the current source.

* * * * *